US008280290B2

(12) United States Patent
Yoshinaga et al.

(10) Patent No.: US 8,280,290 B2
(45) Date of Patent: Oct. 2, 2012

(54) FIXING DEVICE AND IMAGE FORMING APPARATUS

(75) Inventors: Hiroshi Yoshinaga, Chiba (JP); Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 860 days.

(21) Appl. No.: 12/289,250

(22) Filed: Oct. 23, 2008

(65) Prior Publication Data

US 2009/0123202 A1 May 14, 2009

(30) Foreign Application Priority Data

Nov. 13, 2007 (JP) ..... 2007-294232

(51) Int. Cl.
*G03G 15/20* (2006.01)

(52) U.S. Cl. ..... 399/329; 399/328; 399/122
(58) Field of Classification Search ..... 399/329, 399/328, 122
See application file for complete search history.

(56) References Cited

U.S. PATENT DOCUMENTS

| | | | | |
|---|---|---|---|---|
| 7,239,838 | B2 | 7/2007 | Sato et al. | |
| 7,330,682 | B2 * | 2/2008 | Shinshi | 399/122 |
| 7,379,698 | B2 | 5/2008 | Yoshinaga | |
| 2003/0118382 | A1 * | 6/2003 | Tomatsu | 399/328 |
| 2006/0002737 | A1 * | 1/2006 | Shinshi | 399/122 |
| 2007/0077104 | A1 * | 4/2007 | Hasegawa | 399/328 |

FOREIGN PATENT DOCUMENTS

| | | |
|---|---|---|
| JP | 63-221373 | 9/1988 |
| JP | 5-173446 | 7/1993 |
| JP | 2000-214718 | 8/2000 |
| JP | 2001-318555 | 11/2001 |
| JP | 2006-048005 | 2/2006 |

OTHER PUBLICATIONS

Japanese Office Action dated May 29, 2012 for corresponding Japanese Patent Publication No. JP 2007-294232.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

A pressure releasing lever is operated to switch the position of a locking member between a pressure exertion position and a pressure release position. In the pressure exertion position a pressure exerting roller exerts pressure against another roller via a pressure exerting lever and in the pressure release position the pressure exerting roller separates from the roller. An elastic member pulls the locking member and a second end of the pressure exerting lever in a locking direction. A core end of the pressure exerting roller is rotatably supported by a shaft bearing. The pressure exerting lever engages with the shaft bearing.

12 Claims, 9 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document 2007-294232 filed in Japan on Nov. 13, 2007.

BACKGROUND OF THE INVENTION

1. Field of the Invention

The present invention relates to a fixing device that fixes a toner image onto a recording sheet by head and pressure.

2. Description of the Related Art

In an image forming apparatus that uses the electrophotography method, electrostatic latent images are formed on the surface of a photosensitive drum functioning as an image carrying member, the electrostatic latent image is converted to a visible toner image by a developer, the toner image is transferred to a recording sheet by a transfer device, and borne to a fixing device, which fixes the toner image onto the recording sheet by applying heat and pressure. The recording sheet bearing the fixed image is then transported over a discharge path and discharged out of the image forming apparatus.

The fixing device includes a pair of opposing fixing members. The fixing members can be rotating members such as rollers or belts, or stationary members such as pressure pads, or a combination thereof. The recording sheet is clamped between the opposing fixing members and the toner image is fixed onto the recording sheet by applying heat and pressure to both the recording sheet and the toner image.

Of the fixing members, one is typically a heating member, i.e., a fixing roller, with a built-in heater and the other is a pressure lever in the form of a pressure exerting roller that presses against the fixing roller. Upon arriving at the fixing device, the recording sheet bearing the toner image thereon is clamped in a fixing nip formed by the contact portions of the fixing roller and the pressure exerting roller. As the recording sheet passes through the fixing nip, the toner image is fixed to the recording sheet due to heat and pressure from the fixing roller and the pressure exerting roller.

However, when there is jamming of the transfer sheet, if the apparatus stops with the recording sheet stuck in the fixing nip of the fixing device, the jam release operation to release the sheet from the fixing nip can be a tough task. To ease the jam release operation, a well known method of using a manual release lever to manually release the jam is widely used.

However, the manual release lever can be cumbersome to operate and there is a likelihood that the user may forget to operate the lever. To take care of these issues, Japanese Patent Application Laid-open No. H5-173446 discloses an automatic jam releasing device in the form of a cam device that automatically loosens the nip pressure at the fixing nip.

Japanese Patent Application Laid-open No. 2001-318555 discloses a pressure release mechanism in the form of a cam attached to a release lever, which acts on the direct pressure exerting lever to release the pressure exerted by the fixing members. Japanese Patent Application Laid-open No. 2000-214718 discloses a mechanism where the opening and closing of the cover releases the pressure exerted by the fixing members.

The automatic jam releasing cam disclosed in Japanese Patent Application Laid-open No. H5-173446 requires a dedicated motor to drive the cam, making the apparatus heavier as well as costlier.

In response to the demand for a more compact and high speed image forming apparatus, the diameter of the fixing rollers and belts have been reduced, resulting in a narrower nip portion and speedier transit of the sheet through the nip potion. Consequently, the amount of heat applied to the recording sheet by the fixing rollers tends to be inadequate. Therefore, a stronger pressure than in the conventional apparatus must be applied to ensure that the nip portion is effective. As a result, the user must use more power for operating the conventional manual pressure releasing lever which makes the operation difficult.

In the configuration disclosed in Japanese Patent Application Laid-open No. 2001-318555, if stronger pressure is applied, the frictional force between the cam and the direct pressure exerting lever increases, decreasing the slidability and increasing the friction between the sliding contact surfaces.

In the mechanism disclosed in Japanese Patent Application Laid-open No. 2000-214718, if stronger pressure is applied, the frictional force between the release lever and the cover increases, decreasing the slidability and increasing the friction between the sliding contact surfaces.

To provide solutions to the problems described above, a fixing device is disclosed in Japanese Patent Application Laid-open No. 2006-48005. Concretely, a fixing device that clamps a recording sheet between a first fixing member and a second fixing member and fixes a toner image on the recording sheet by applying heat and pressure, includes a pressure exerting lever that causes the first fixing member to exert pressure on the second fixing member, the pressure exerting lever having a first end and a second end, the first end being rotatably supported by a first pivot; a pressure releasing lever that is rotatably supported against the pressure exerting lever; a locking member having a first end and a second end, the first end being rotatably supported against the first end of the pressure releasing lever; and an elastic member that is hooked to the second end of the locking member and that pulls the locking member in a locking direction. By turning the pressure releasing lever, a position of the locking member is switched between a pressure exertion position where the first fixing member exerts pressure against the second fixing member via the pressure exerting lever, and a pressure release position where the fixing member separates from the second fixing member. In the pressure exertion position, the elastic member pulls the locking member and the second end of the pressure exerting lever in the locking direction.

The fixing device includes a pair of fixing members, a pressure exerting lever that exerts pressure on one fixing member, pressing it towards the other, a pressure releasing lever rotatably supported against the pressure exerting lever, a locking member whose one end is rotatably fitted to the pressure releasing lever, and hooked to the other end of the locking member an elastic member that pulls the locking member in a locking direction. When the pressure releasing lever rotates, the locking member shifts between a pressure contact position where one fixing member exerts pressure on the other fixing member via the pressure exerting lever, and a pressure releasing position where there is a gap between the two fixing members. Thus, the need for a cam or a cam driving unit is obviated, and a light and inexpensive apparatus can be realized. When the pressure releasing lever rotates, the locking member, whose one end is engaged with the pressure releasing lever, also shifts its position. Therefore, the elastic member extends minimally and the user needs to exert very little operating force. The pressure exerting lever and the locking member are locked at a position far from rotational center of the pressure exerting lever and the elastic member is configured to pull the locking member. Therefore, the component sliding over the locking member receives decreased frictional force and has high durability.

However, the core end of the fixing member is rotatably supported by a shaft bearing. The pressure exerting lever presses against the shaft bearing, causing one fixing member to come in pressure contact with the other fixing member. Generally, a ball bearing (or slide bearing) is used as shaft bearing. In either case, the shaft bearing deforms and is damaged because of a localized force exerted on the outer periphery of the shaft bearing, resulting in the fixing member not rotating smoothly, and therefore causing problems in locking. Particularly, in a mechanism provided keeping in mind the convenience of the user whereby the fixing members assume pressure contact and pressure release positions with the opening and closing of the cover, the shaft bearing receives severe impact via the pressure exerting lever during pressure exertion when the cover is tightly shut, making the shaft bearing even more vulnerable to deformation. Further, apart from jam release, the cover can be opened and closed for a number of other reasons. Thus, repeated pressure exertion causes the shaft bearing to receive impact that many times, further increasing the risk of deformation.

Even if the fixing device is configured such that the pressure exerting lever and the shaft bearing are in contact, due to the sheer number of components in the fixing device, a slight distortion can occur in the stacking of the components, resulting in a point contact between the pressure exerting lever and the shaft bearing and a localized force is exerted. Due to the variation in the elastic member used in the fixing device, force exceeding the load capacity of the shaft bearing is exerted on the shaft bearing when opening and closing the cover, damaging the shaft bearing.

Further, because the core end of the fixing member is rotatably supported by the shaft bearing, and the pressure exerting lever pushes the shaft bearing to cause one fixing member to exert pressure on the other fixing member, the shaft bearing does not necessarily move with the pressure exerting lever, particularly during pressure release. Thus, even if the pressure exerting lever is at the pressure releasing position, one fixing member may well be touching the other fixing member. In an arrangement of the fixing members where the upper fixing member is a fixing roller and the lower fixing member is a pressure exerting roller, when the pressure exerting lever shifts to the pressure releasing position, the pressure exerting roller shifts downwards away from the fixing roller due to self weight. However, in an arrangement where the fixing roller and the pressure exerting roller are disposed side by side, the two fixing members are touching each other even if the pressure exerting lever shifts to the pressure releasing position.

When the image forming apparatus stops due to the jamming of the transfer sheet, there are instances when the transfer sheet is stuck in the fixing device. When such a transfer sheet, bearing thereon unfixed toner image downstream of the fixing nip, is pulled from the side upstream of the fixing nip with the fixing members touching each other (that is, with no gap between them), the unfixed toner from the transfer sheet is smeared on the fixing members. As a result, faulty image is formed when the next transfer sheet passes through the fixing members. Further, it is not easy to pull out the transfer sheet intact from the nip.

SUMMARY OF THE INVENTION

It is an object of the present invention to at least partially solve the problems in the conventional technology.

According to an aspect of the present invention, there is provided a fixing device that clamps a recording sheet between a first fixing member and a second fixing member and fixes a toner image on the recording sheet by applying heat and pressure. The fixing device includes a pressure exerting lever that causes the first fixing member to exert pressure on the second fixing member, the pressure exerting lever having a first end and a second end, the first end being rotatably supported by a first pivot; a pressure releasing lever that is rotatably supported against the pressure exerting lever; a locking member having a first end and a second end, the first end being rotatably supported against the first end of the pressure releasing lever; and an elastic member that is hooked to the second end of the locking member and that pulls the locking member in a locking direction. By turning the pressure releasing lever, a position of the locking member is switched between a pressure exertion position where the first fixing member exerts pressure against the second fixing member via the pressure exerting lever, and a pressure release position where the fixing member separates from the second fixing member. In the pressure exertion position, the elastic member pulls the locking member and the second end of the pressure exerting lever in the locking direction. A core end of the fixing member pressed by the pressure exerting lever is rotatably supported by a shaft bearing, and the pressure exerting lever is engaged with the shaft bearing.

According to another aspect of the present invention, there is provided an image forming apparatus that includes the above fixing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
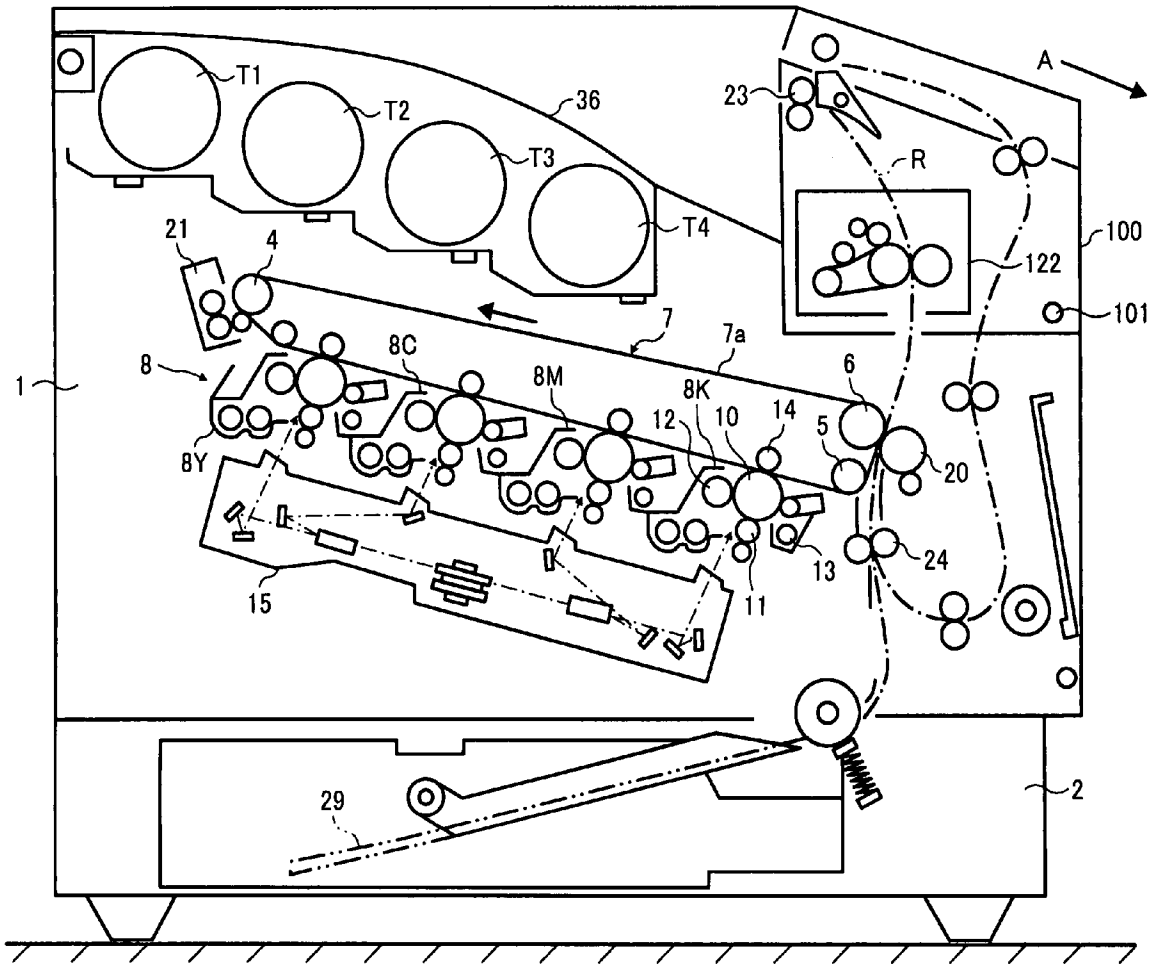
FIG. 1 is a side view of an image forming apparatus according to an embodiment of the present invention.

FIG. 1 is a schematic configuration diagram of an image forming apparatus according to an embodiment of the present invention. The image forming apparatus is a tandem type full color printer (hereinafter, "printer") that uses the electrophotography method. The image forming apparatus can be a copying machine or a facsimile machine, apart from the printer.

The basic structure and operations of the printer are explained first with reference to FIG. 1 followed by the structure and function peculiar to the embodiment.

In the printer shown in FIG. 1, below an apparatus body 1, which forms the basic unit, is disposed a paper feeding unit 2 that contains transfer sheets 29 serving as a recording medium. An image forming unit 3 is disposed above the paper feeding unit 2. The image forming unit 3 includes an imaging block 8, an intermediate transfer unit 7, an optical writing unit 15, and a fixing device 22. The imaging block 8 includes four imaging units 8Y, 8C, 8M, and 8K, each equipped with an image carrying unit. The intermediate transfer unit 7 includes a plurality of rollers 4 to 6 and an intermediate transfer belt 7*a* that in the form of a flexible endless belt wound around the rollers 4 to 6. The optical writing unit 15 performs optical writing on the image carrying units. The fixing device 22 fixes a toner image on the transfer sheet 29. The imaging units 8Y, 8C, 8M, and 8K and the intermediate transfer unit 7 are detachable from the apparatus body 1. The transfer sheet 29 traverses a transport pathway R from the paper feeding unit 2 to the fixing device 22. The roller 6 is disposed facing the transport pathway R. In the embodiment, the intermediate transfer unit 7, the imaging block 8, the optical writing unit 15, and the fixing device 22 form the internal components of the image forming apparatus, occupying substantially mid portion of the apparatus body 1.

The part of the intermediate transfer belt 7*a* between the rollers 4 and 5 corresponds to a lower running side of the intermediate transfer belt 7*a*. A secondary transfer roller 20 that serves as a secondary transfer device is disposed facing the roller 6 at the position of the intermediate transfer belt 7*a* where the roller 6 is disposed. Thus, the secondary transfer roller 20 also faces the transport pathway R. A belt cleaning device 21 that cleans the surface of the intermediate transfer belt 7*a* is disposed facing the roller 4 at the position of the intermediate transfer belt 7*a* where the roller 4 is disposed.

The imaging block 8 is disposed below the intermediate transfer belt 7*a*, facing the lower running side of the intermediate transfer belt 7*a*. Each of the imaging units 8Y, 8C, 8M, and 8K of the imaging block 8 includes a photosensitive drum 10, serving as the image carrying unit, that is in contact with the intermediate transfer belt 7*a*. Arranged around the photosensitive drum 10 are a charging device 11, a developing device 12, and a cleaning device 13. A transfer roller 14 each is provided on the inner side of the intermediate transfer belt 7*a* at the point where each photosensitive drum 10 touches the intermediate transfer belt 7*a*.

The imaging units 8Y, 8C, 8M, and 8K are identical structurally and functionally. The only difference among the imaging units 8Y, 8C, 8M, and 8K is the color of the toner, which is a developing agent, contained in the developing device 12. The developing device 12 of the imaging units 8Y, 8C, 8M, and 8K contains, respectively, yellow toner, cyan toner, magenta toner, and black toner. When the level of the toner drops in the developing device 12, the toner of respective color is supplied to the developing device 12 from toner supplying bottles T1 to T4 disposed above the apparatus body 1.

The optical writing unit 15 is disposed below the imaging block 8 in the embodiment and irradiates the surface of the photosensitive drum 10 with a laser beam that is optically modulated, forming thereon a latent image of the concerned color.

The toner supplying bottles T1 to T4, the intermediate transfer unit 7, the imaging block 8, and the optical writing unit 15 are disposed slanting in the same direction within the apparatus body 1. When arranged in this manner, a smaller footprint is realized as compared to when the parts are arranged horizontally.

When the image forming apparatus is started, a driving device (not shown) drives the photosensitive drum 10 of each of the imaging units 8Y, 8C, 8M, and 8K to rotate in the clockwise direction. The charging device 11 charges the surface of the photosensitive drum 10 uniformly to a predetermined polarity. A laser beam from the optical writing unit 15 irradiates the surface of the photosensitive drum 10, forming thereon an electrostatic latent image of the concerned color.

The image data exposed on each photosensitive drum 10 is a single color image data obtained by decomposing a full color image data of yellow, cyan, magenta, and black. The electrostatic latent image is converted to a visible toner image by the toner in the developing device 12.

Of the rollers 4 to 6 around which the intermediate transfer belt 7*a* is wound, one roller is driven to rotate in the counter-clockwise direction by a driving device (not shown), causing the intermediate transfer belt 7*a* to run in the counter-clockwise direction indicated by the arrow in FIG. 1, and the other rollers to be driven to rotate. A yellow toner image formed by the imaging unit 8Y that contains the developing device 12 containing the yellow toner is transferred on to the running intermediate transfer belt 7*a* by the transfer roller 14.

A cyan image, a magenta image, and a black image, formed respectively by the imaging unit 8C, the imaging unit 8M, and the imaging unit 8K, are sequentially superposed on the yellow image on the intermediate transfer belt 7*a*, the surface of the intermediate transfer belt 7*a* eventually bearing a full color toner image.

The cleaning device 13 removes residual toner from the surface of the photosensitive drum 10 after transfer of the toner image. A neutralizing device (not shown) neutralizes the surface of the photosensitive drum 10, resetting the surface potential and preparing the surface for the next round of image formation.

The transfer sheet 29 from the paper feeding unit 2 is sent over the transport pathway to reach the point between the roller 6 and the secondary transfer roller 20 at a timing calculated by a pair of registration rollers 24 disposed closer to the paper feeding unit 2 than the secondary transfer roller 20. When the transfer sheet 29 reaches the secondary transfer roller 20, a transfer voltage of a polarity opposite to that of the toner charging polarity of the toner image on the surface of the intermediate transfer belt 7*a* is impressed on the secondary transfer roller 20. As a result, the toner image on the surface of the intermediate transfer belt 7*a* is transferred in entirely to the transfer sheet 29.

The transfer sheet 29, now carrying the toner image, is transported to the fixing device 22, where the toner image is fixed to the transfer sheet 29 by application of heat and pressure. The transfer sheet 29 with the toner image fixed to it is transported to a discharging unit 23 which forms the upper portion of the apparatus body 1, and is discharged to a stacking unit 36 provided above the apparatus body 1. After the transfer of the toner image, the residual toner on the intermediate transfer belt 7*a* is removed by the belt cleaning device 21.

The printer having a configuration explained above with four imaging units 8Y, 8M, 8C, and 8K and the intermediate transfer belt 7*a* can thus drastically reduce the time required for image formation as compared to a printer having only one imaging unit and four developing devices and which superposes toner images one by one on the intermediate transfer belt and transfers them on to the transfer sheet 29. Further, as the stacking unit 36 is provided above the apparatus body 1, the footprint is reduced.

The printer explained above can function as a full color image printer as well as a single color image or two-color or three-color image printer. When using the printer for monochrome printing, only the photosensitive drum 10 of the imaging unit 8K is used for forming the electrostatic latent image, which is developed by the developing device 12 of the imaging unit 8K, transferred to the transfer sheet 29, and the toner image fixed by the fixing device 22.

A cover 100 that swings about a fulcrum 101 to open or close against the apparatus body 1 is provided in the portion of the apparatus body 1 where the fixing device 22 is disposed. The cover 100 is shown in a closes state in FIG. 1. When the cover 100 is swung open in the direction indicated by the arrow A in FIG. 1, the portions surrounding the fixing device 22 are exposed to the outside. A portion of the fixing device 22 is configured to move along with the opening and closing of the cover 100, as explained later.

Figure 2A:
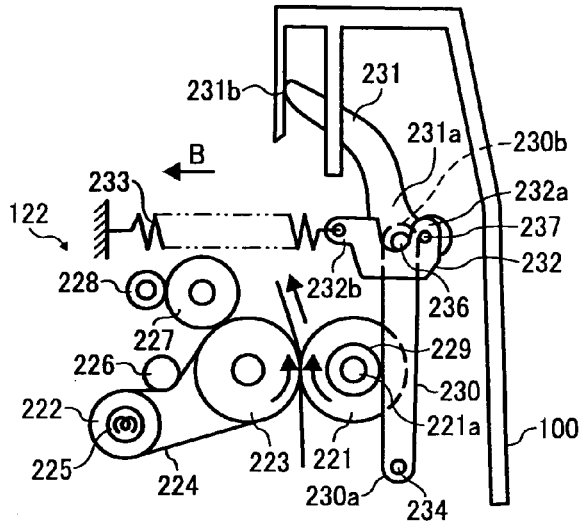
FIG. 2A is an enlarged view of a fixing device shown in FIG. 1 in a pressure exertion state and a cover in a closed state.
Figure 2B:
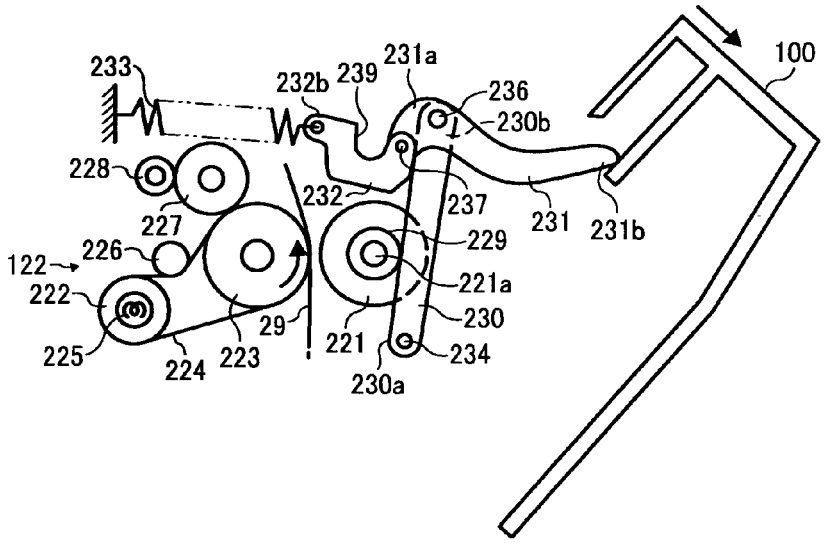
FIG. 2B is an enlarged view of the fixing device in a pressure release state and the cover in an open state.
Figure 2C:
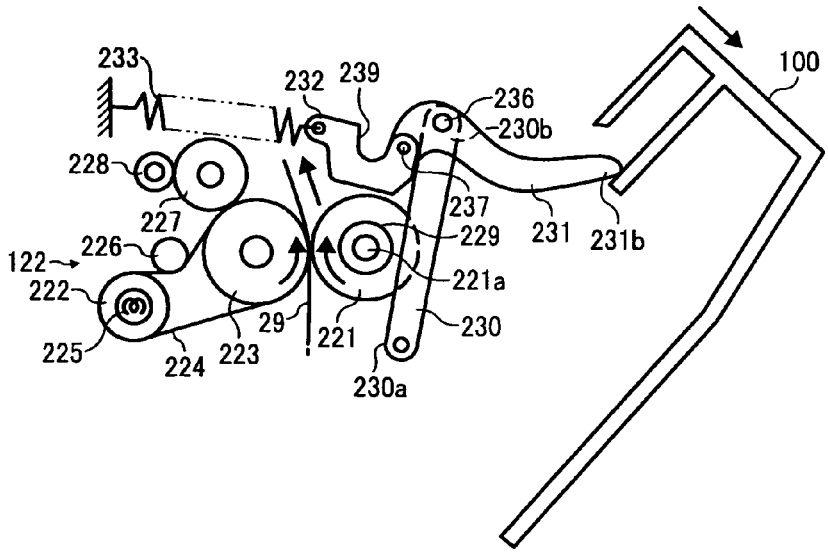
FIG. 2C is an enlarged view of the fixing device in the pressure release state with a fixing belt and a fixing roller in contact with each other.

FIG. 2A is an enlarged view of the structure around the fixing device 22 in a pressure exertion state and a cover in a closed state, FIG. 2B is an enlarged view of the structure around the fixing device 22 in a pressure release state and the cover in an open state, and FIG. 2C is an enlarged view of the structure around the fixing device 22 in the pressure release state with a fixing belt and a fixing roller in contact with each other. The fixing device 22 includes a pressure exerting roller 221 and a fixing belt 224 as fixing members. The fixing belt 224 is wound around a pair of rollers 222 and 223. The roller 222 includes within it a heat source 225 connected to a power source (not shown), and functions as a heating roller.

The roller 223 has a core made of metal such as iron or SUS, covered by a sponge rubber such as styrene silicon rubber, and serves as a drive roller driven to rotate by a driving motor (not shown). The rollers 222 and 223 are rotatably supported against the side plate (not shown). The rollers 222 and 223 and the fixing belt 224 rotate in the counter-clockwise direction in FIG. 2A, and the pressure exerting roller 221, by being in contact with the fixing belt 224, is driven to rotate in the clockwise direction. The state in which the rollers 221 and 223 are in pressure contact with each other via the fixing belt 224 is called the pressure exertion state. On the other hand, the state in which the rollers 221 and 223 are separated from each other as shown in FIG. 2A or 2C is called the pressure release state.

The pressure exerting roller 221 has a core made of metal such as aluminium covered by silicon rubber, which form an elastic layer, and finally by a surface layer, which is a release layer form of a tetra fluoro ethylene-perfluoro alkylvinyl ether copolymer (such as PFA) or poly tetra fluoro ethylene (PTFE).

A core end 221*a* of the pressure exerting roller 221 is rotatably supported by a shaft bearing 229. The shaft bearing 229 is supported by the side plate (not shown) to move the pressure exerting roller 221 towards or away from the roller 223. An elastic force of a tension coil spring 233, which is explained later, causes a pressure exerting lever 230 to push against the outer peripheral surface of the shaft bearing 229, causing the surface of the pressure exerting roller 221 to be in pressure contact with/separated from the fixing belt 224.

The fixing device 22 is the one that is disclosed in Japanese Patent Application Laid-open No. 2006-48005. In the fixing device 22, even if the pressure exerting lever 230 moves away from the shaft bearing 229 so that the fixing device 22 enters into the pressure release state shown in FIG. 2C, the surface of the pressure exerting roller 221 and the surface of the fixing belt 224 may still be in contact although the pressure exerting roller 221 and the fixing belt 224 may not be in pressure contact.

Figure 8A:
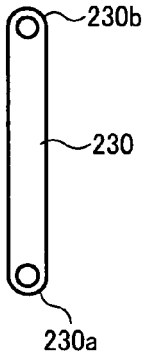
FIG. 8A is a drawing of a conventional pressure exerting lever.
Figure 8B:
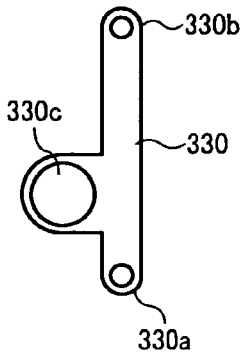
FIG. 8B is a drawing of a pressure exerting lever according to an embodiment of the present invention.
Figure 8C:
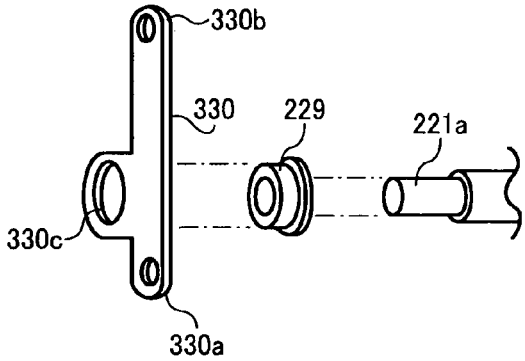
FIG. 8C is a schematic diagram representing an assembly of the pressure exerting lever according to the embodiment, a shaft bearing, and an end of the pressure exerting roller.

To solve this issue, in the present invention, the following provision has been made. FIG. 8A is a drawing of the pressure exerting lever 230, and FIG. 8B is a drawing of a pressure exerting lever 330 used in a fixing device 122 according to the embodiment. A fitting hole 330*c* is provided in the pressure exerting lever 330 to enable the shaft bearing 229 to fit into. As shown in FIG. 8C, the shaft bearing 229 fits into the fitting hole 330*c*, and the core end 221*a* of the pressure exerting roller 221 is rotatably supported in the inner diameter of the shaft bearing 229. Thus, the pressure exerting lever 330 supports the entire outer periphery of the shaft bearing 229. Therefore, no localized force acts on the outer periphery causing the shaft bearing 229 to deform, and thus faulty rotation due to damage to the shaft bearing 229 can be prevented. Further, even in the mechanism provided keeping in mind the convenience of the user whereby the pressure exerting roller 221 assumes pressure contact and pressure release positions with the opening and closing of the cover 100, the impact received by the shaft bearing 229 via the pressure exerting lever 330 is dispersed even when the cover 100 is tightly shut during pressure exertion, thus preventing deformation of the shaft bearing 229. Thus supported, the shaft bearing 229 can withstand even repeated impacts.

By configuring the shaft bearing 229 to fit into the pressure exerting lever 330 distortion in the stacking of components and point contact between the pressure exerting lever 330 and the shaft bearing 229 can be prevented. The shaft bearing 229 can also withstand force exceeding its load capacity exerted when opening and closing the cover 100 due to the variation in the elastic member used in the fixing device 122.

Further, due to the engagement of the pressure exerting lever 330 and the shaft bearing 229, the pressure exerting lever 330 is in the pressure release position or pressure contact position according to whether the cover 100 is open or closed, and the shaft bearing 229 shift according to whether the pressure exerting lever 330 is in the pressure release position or pressure contact position. Consequently, The surface of the pressure exerting roller 221 can be made to be clearly in pressure contact with/separated from the fixing belt 224. Thus, the problem of faulty image produced by unfixed toner from the transfer sheet smearing on the fixing members due to the fixing members touching each other (that is, with no gap between them) can be prevented. Further, the problem of the jammed transfer sheet not being able to be easily pulled out from the nip is resolved.

Figure 10A:
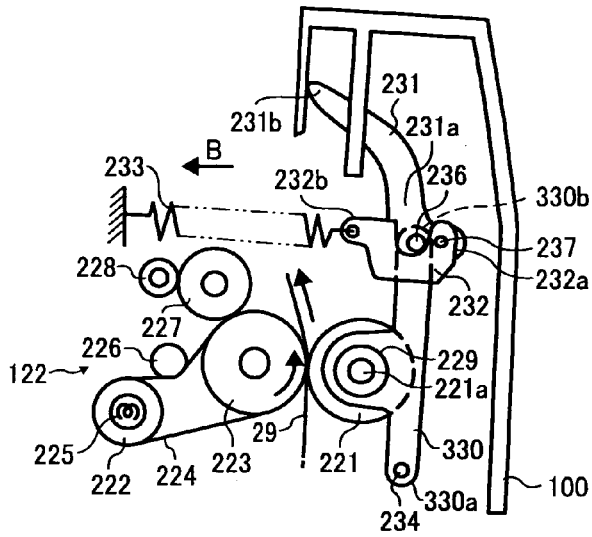
FIG. 10A is an enlarged view of a fixing device according to an embodiment of the present invention in a pressure exertion state and a cover in a closed state.
Figure 10B:
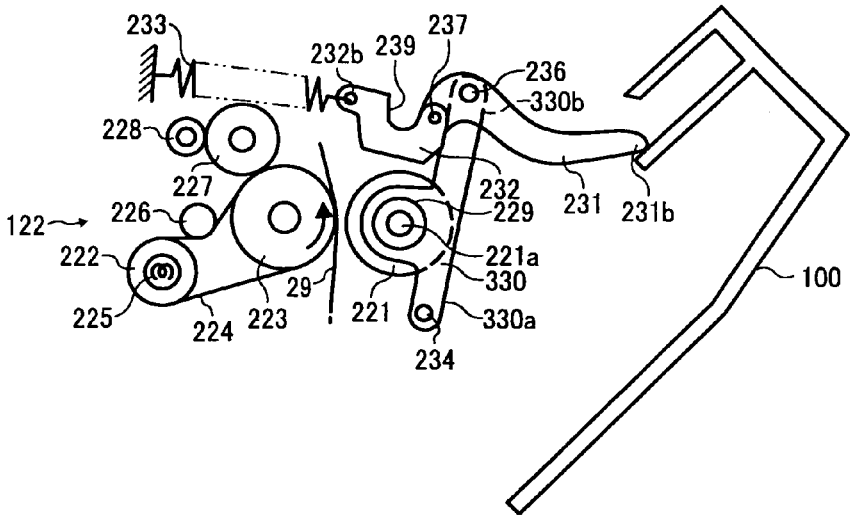
FIG. 10B is an enlarged view of the fixing device according to the embodiment in a pressure release state and the cover in an open state.

FIG. 10A is an enlarged view of the structure around the fixing device 122 in a pressure exertion state and a cover in a closed state, and FIG. 10B is an enlarged view of the structure around the fixing device 122 in a pressure release state and the cover in an open state. Similar to the fixing device 22, the fixing device 122 includes the pressure exerting roller 221 and the fixing belt 224 as fixing members. The fixing belt 224 is wound around the rollers 222 and 223. The roller includes within it the heat source 225 connected to a power source (not shown), and functions as a heating roller. The roller 223 serves as a drive roller driven to rotate by a driving motor (not shown). The rollers 222 and 223 are supported by the side plate (not shown). The rollers 222 and 223 and the fixing belt 224 rotate in the counter-clockwise direction in FIG. 10A, and the pressure exerting roller 221, by being in contact with the fixing belt 224, is driven to rotate in the clockwise direction.

The pressure exerting roller 221 has a core made of metal such as aluminium covered by silicon rubber, which form an elastic layer, and finally by a surface layer, which is a release layer form of a tetra fluoro ethylene-perfluoro alkylvinyl ether copolymer (such as PFA) or poly tetra fluoro ethylene (PTFE).

The core end 221*a* of the pressure exerting roller 221 is rotatably supported by the shaft bearing 229. The shaft bearing 229, fitted to the pressure exerting lever 330, is supported by the side plate (not shown) to move the pressure exerting roller 221 towards or away from the roller 223, causing the surface of the pressure exerting roller 221 to be in pressure contact with/separated from the fixing belt 224.

Thus, by providing a mechanism whereby the shaft bearing 229 is fitted to the pressure exerting lever 330, a more durable fixing device with improved operability and an image forming apparatus equipped with such a fixing device can be provided. Further, a clear separation of one fixing member from the other fixing member can be achieved during pressure release, thus preventing faulty image formation after jamming occurs. Further, the transfer sheet stuck in the fixing device can be easily freed.

According to another aspect of the present invention the luster sought in the output image is varied according to the type of paper used or according to the requirement. Typically, various types of recording sheets are used in a printer to obtain a desired result. As a result, an adaptive fixing capability to suit different types of transfer sheet is sought.

Figure 9:
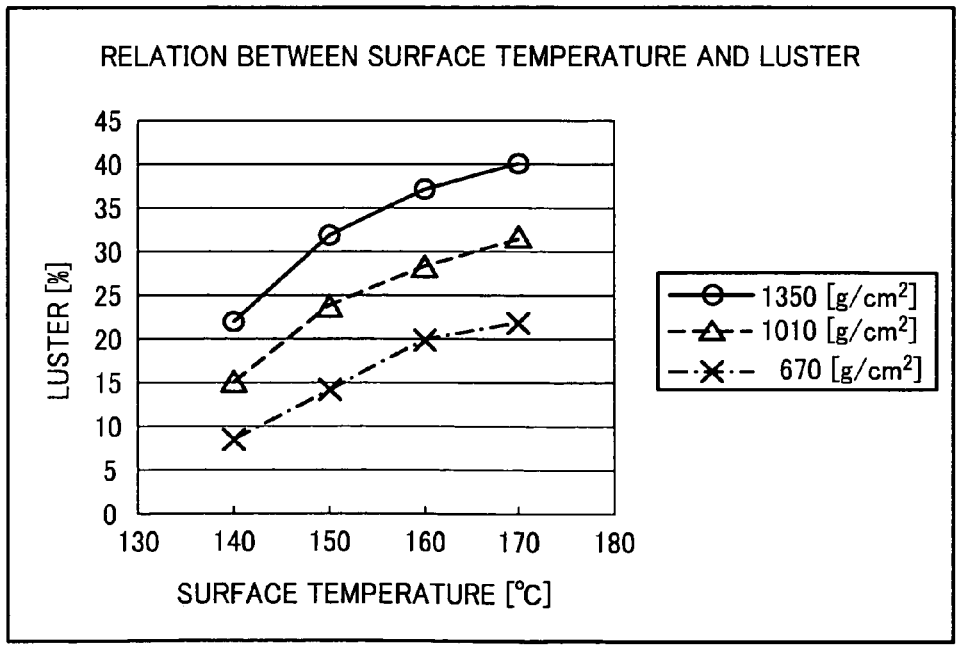
FIG. 9 is a graph representing a relation between a surface temperature of the fixing member and luster.

FIG. 9 is a graph representing a relation between a surface temperature of the fixing members and luster when a clamping pressure of the recording sheet is changed. The standard surface pressure of the fixing device 122 is 1010 g/cm$^2$. Luster can be increased by increasing the surface pressure to 1350 g/cm$^2$, and decreased by decreasing the surface pressure to 670 g/cm$^2$. The surface pressures mentioned here are unique for each fixing device. The surface pressure can vary depending on the attribute of the toner being used. Therefore, the center value or variable range may be best set according to the fixing device and the toner being used. The luster is measured with a glossmeter GM-60 (measurement angle=60°), manufactured by Minolta Co., Ltd.

Figure 11:
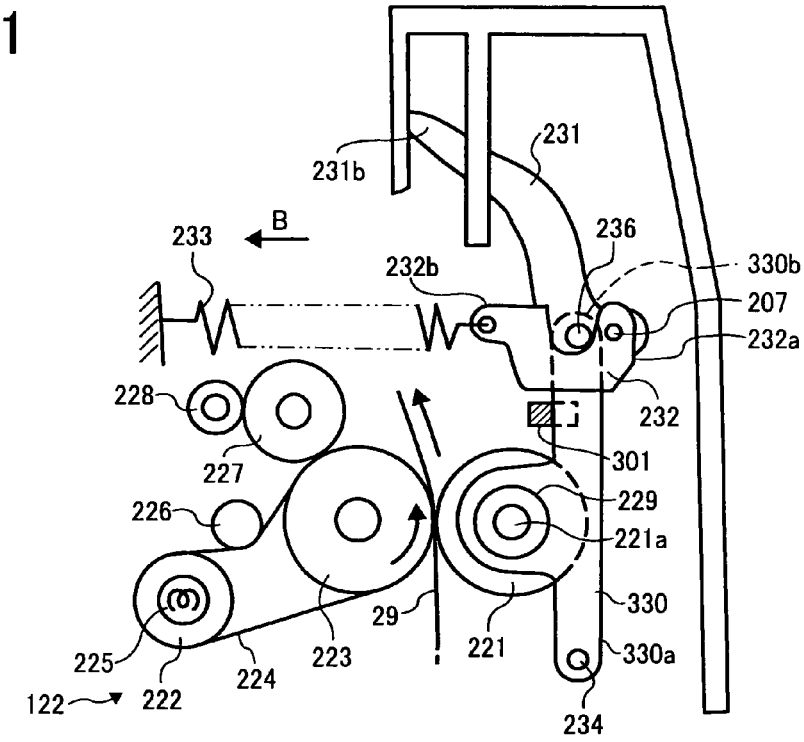
FIG. 11 is an enlarged view of a pressure control member of a fixing device according to another embodiment of the present invention.

Concretely, a pressure control member 301 is provided in the side plate (not shown), touching the pressure exerting lever 330 of the fixing device 122, for adjusting the center distance between the pressure exerting roller 221 and the roller 223 (see FIG. 11). In the fixing device that does not have the pressure control member 301 (for example, the fixing device 22 shown in FIGS. 2A to 2C), the center distance between the pressure exerting roller 221 and the roller 223 is substantially determined by the strength of the tension coil spring 233 and the hardness of the sponge rubber used in the roller 223. However, in such a fixing device, the nip width varies due to variations in the characteristics of the tension coil spring 233 or the roller 223, the sponginess of the sponge rubber layer of the roller 223 will decline over time, and the nip will change shape due to narrowing of the center distance between the pressure exerting roller 221 and the roller 223, changing the approaching angle of the transfer sheet. On the other hand, provision of the pressure control member 301 ensures that the center distance is always maintained constant. Further, even if a large center distance (or a narrow nip) is realized by the fitting the shaft bearing 229 to the pressure exerting lever 330, variations in the center distance or the nip can be prevented. The pressure control member 301 can be made of a material that can control the position of the pressure exerting lever 330 such as metal or resin. The pressure control member 301 can be in the form of a pin inserted into an opening provided at a predetermined position in a side plate 310. The pressure control member 301 can be of any material, rigidity, or configuration as long as it can maintain a constant center distance between the pressure exerting roller 221 and the roller 223.

When the pressure exerting lever 330 is in the pressure exertion position, the tension coil spring 233 pulls the pressure exerting roller 221 towards the roller 223. However, the position of the pressure exerting lever 330 is controlled by the pressure control member 301, the center distance between the pressure exerting roller 221 and the roller 223 is maintained at a predetermined value, a surface pressure of 1010 g/cm$^2$ is maintained even if there are variations in the tension coil spring 233. The tension coil spring 233 has the elastic force required for the pressure exerting lever 330 to touch the pressure control member 301. Another pressure control member 301 is provided at the opposite end of the core end 221*a* so that the center distance between the pressure exerting roller 221 and the roller 223 is the same at both the ends. Thus, variation in the nip width, which can potentially cause the transfer sheet to skew or wrinkle, can be prevented.

Figure 12:
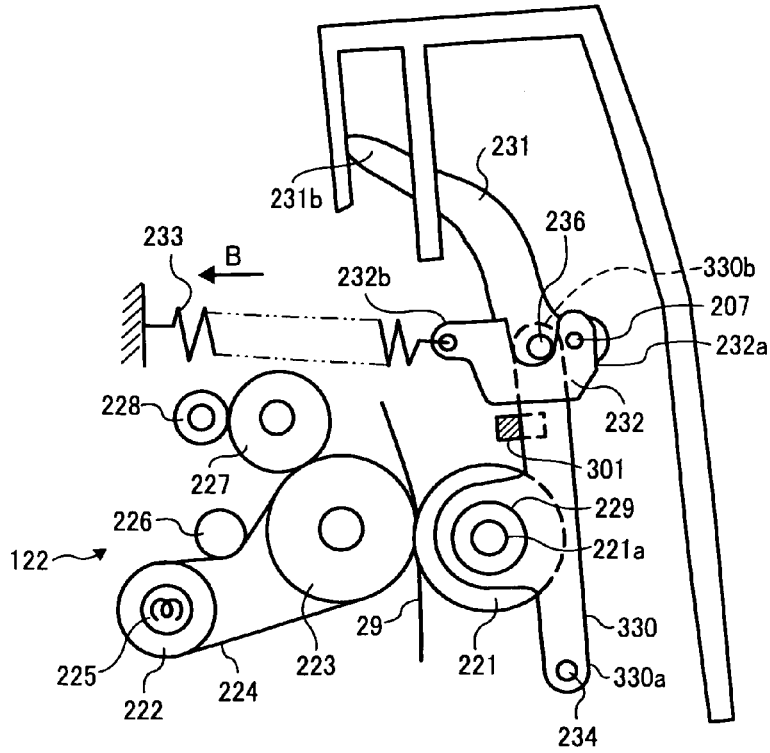
FIG. 12 is an enlarged view of a pressure control member of a fixing device according to still another embodiment, where the position of the pressure control member is variable.

FIG. 12 is an enlarged view of the fixing device whose position is variable.

As shown in FIG. 12, the pressure control member 301 is provided closer to the roller 223 than the pressure control member 301 shown in FIG. 11 (the pressure control member 301 at the opposite end (not shown) is similarly positioned). As a result, a center distance that is smaller than the one from the configuration shown in FIG. 11 can be obtained between the pressure exerting roller 221 and the roller 223 can be maintained, thus enabling a high surface pressure to be maintained between the pressure exerting roller 221 and the roller 223. By maintaining a high surface pressure, the luster of the output image can be heightened, which is ideal for image output on a coated paper.

Alternatively, the pressure control member 301 can be provided farther from the roller 223. Thus, a center distance greater than that shown in FIG. 11 can be maintained between the pressure exerting roller 221 and the roller 223, and lower surface pressure can be maintained between the pressure exerting roller 221 and the roller 223. Thus, wrinkling can be prevented when performing fixing on a thick transfer sheet such as an envelope. This setting of the pressure control member 301 is ideal for low luster image outputs.

Figure 13A:
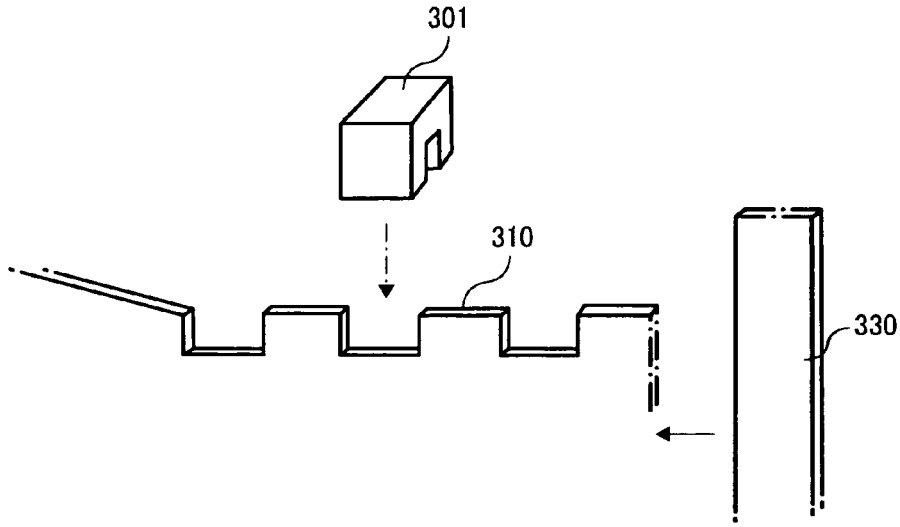
FIGS. 13A to 13C are an enlarged views of a pressure control members of fixing devices according to other embodiments, where the position of the pressure control member is variable.
Figure 13B:
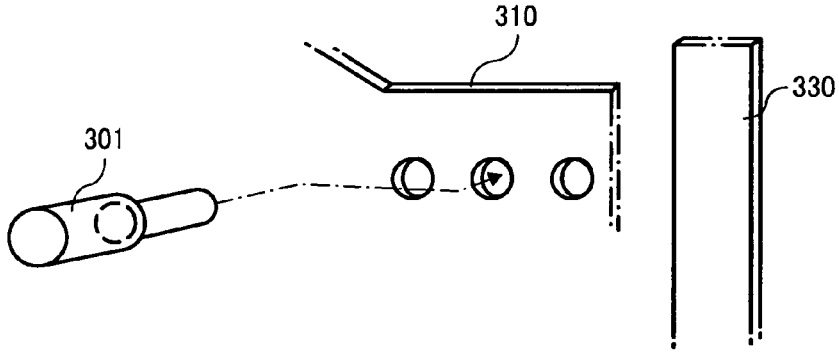
Figure 13C:
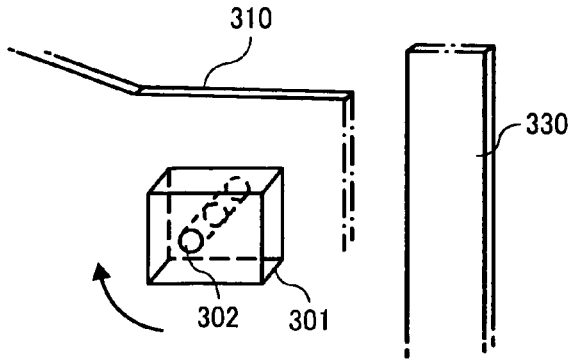

The pressure control member 301 can be configured to be block-shaped, pin-shaped, or quadratic prism-shaped and such that its position can be changed stepwise. In the case of the block-shaped pressure control member 301, as shown in FIG. 13A, a plurality of notches can be provided on the side plate, and the pressure control member 301 can be fitted into any of the notches for obtaining the desired pressure. In the case of the pin-shaped pressure control member 301, as shown in FIG. 13B, a plurality of slots are provided in the side plate 310, and the pressure control member 301 can be inserted into any of the slots for obtaining the desired pressure. In the case of the quadratic prism-shaped pressure control member 301, provided to be rotatable eccentrically in relation to the center, as shown in FIG. 13C, the position of the pressure control member 301 can be changed by rotating the pressure control member 301 and changing the distance between a reference point (rotation point) 302 of the side plate 310 and the pressure exerting lever 330.

Figure 14:
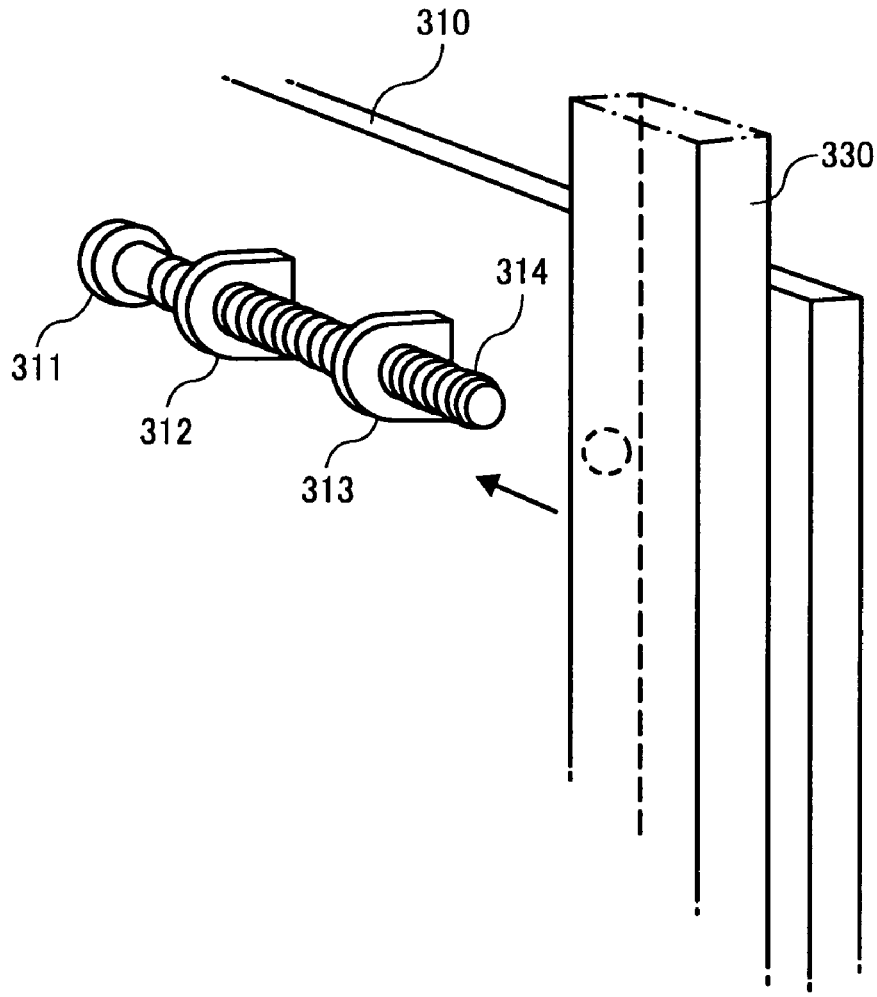
FIG. 14 is an enlarged view of a pressure control member of a fixing device according to still another embodiment, where the position of the pressure control member is variable.

FIG. 14 is a drawing of a pressure control member 311 whose position can be changed continuously. Brackets 312 and 313 provided on the side plate 310 hold a screw-shaped pressure control member 311. The inner diameter of each of the brackets 312 and 313 is a screw hole for the pressure control member 311. Thus, by turning the pressure control member 311, the position of the pressure control member 311 can be continuously changed relative to the side plate 310. When the pressure exerting lever 330 touches an end 314 of the pressure control member 311 after the pressure control member 311 is set at a predetermined position, desired surface pressure can be obtained between the pressure exerting roller 221 and the roller 223. This configuration of the pressure control member 311 which enables continuous change in pressure allows finer luster control and renders the fixing device adaptable to a wider variety of transfer sheets. Further, it is useful for adjusting the surface pressure when desired surface pressure cannot be obtained due to the sponge rubber layer of the roller 223 losing its elasticity over time.

The configuration explained above can be realized using a belt fixing method.

FIG. 9 is a graph indicating a relation between the surface temperature of the fixing member and the luster with the change in the surface pressure on the recording sheet. It can be surmised from FIG. 9 that the luster can be controlled by controlling the surface temperature of the fixing member along with the surface pressure. A fixing device that can be adapted to a wider range of transfer sheets can be realized by changing the surface pressure and the surface temperature according to the type of paper used as the transfer sheet.

A halogen heater is used as the heat source 225 that heats up the roller 222 and the fixing belt 224, that function as heat receiving members and heat circulating members. The heat source 225 can heat up the roller 222 and the fixing belt 224 by either of the induction heating methods disclosed in Japanese Patent Application Laid-open Nos. 2001-242732 and 2001-13805. The power source for the heat source 225 can be a normal commercial power source (100 V). An auxiliary power source can be used complimenting the commercial power source, and power can be supplied from the auxiliary power source. The electrical double-layer capacitor (electrochemical capacitor) disclosed in Japanese Patent Application Laid-open No. 2002-174988 is preferable. A heating roller is used as the heat circulating member in the present embodiment. The heat circulating member can be either of the endless belts disclosed in Japanese Patent Application Laid-open Nos. H11-232307 and 2001-66933. In the diagrams, the reference numerals 226, 227, and 228 denote a belt tension roller, a belt cleaning roller, and a cleaning brush, respectively. In the present embodiment, the belt tension roller 226 exerts tension on the fixing belt 224 from the outside. The belt tension roller 226 can be placed on the inner side of the fixing belt 224 so as to exert tension on the fixing belt 224 from inside.

The fixing device 122 includes the pressure exerting roller 221, the fixing belt 224, the pressure exerting lever 330 that exerts pressure on the pressure exerting roller 221, pressing it towards the fixing belt 224, a pressure releasing lever 231 rotatably supported against the pressure exerting lever 330, a locking member 232 whose first end 232*a* is fitted to the pressure releasing lever 231, and the tension coil spring 233 that pulls the locking member 232 in a locking direction hooked to a second end 232*b* of the locking member 232. When the pressure releasing lever 231 rotates, the locking member 232 shifts between a pressure contact position where the pressure exerting roller 221 exerts pressure on the fixing belt 224 via the pressure exerting lever 330, and a pressure releasing position where there is a gap between the pressure exerting roller 221 and the fixing belt 224.

In other words, a first end 330*a*, which is the lower end, of the pressure exerting lever 330 is rotatably supported against the side plate (not shown) by a first pivot 234. A base end 231*a* of the pressure releasing lever 231 is rotatably supported against a second end 330*b*, which is the upper end, of the pressure exerting lever 330 by a second pivot 236.

A tip end 231*b* of the pressure releasing lever 231 engages with the inside of the cover 100, and slides as the cover 100 is closed as shown in FIG. 10A or opened as shown in FIG. 10B.

The first end 232*a* of the locking member 232 is rotatably supported against the base end 231*a* of the pressure releasing lever 231 by a third pivot 237. When the locking member 232 assumes a locked position shown in FIG. 10A and a lock release position shown in FIG. 10B, the third pivot 237 moves to one side or the other side of the second pivot 236 that functions as a hinge for the pressure releasing lever 231.

In the present embodiment, when the pressure releasing lever 231 is in the locked position shown in FIG. 10A, the third pivot 237 assumes a position on the opposite side of the second end 232*b* of the locking member 232 with respect to the second pivot 236, and when the pressure releasing lever 231 is in the lock releasing position shown in FIG. 10B, the third pivot 237 assumes a position on the same side as the second end 232*b* of the locking member 232 with respect to the second pivot 236. When the pressure releasing lever 231 assumes the position between the first end 232*a* and the second end 232*b* of the locking member 232 as shown in FIG. 10A, the second pivot 236 gets thrusts forth and holds the locking member 232 and the pressure exerting lever 330 in the locked position. When the pressure releasing lever 231 assumes the lock release position shown in FIG. 10B, the second pivot 236 retreats to expose a recessed portion 239, releasing the locking of the locking member 232 and the pressure exerting lever 330. In the present embodiment, the pressure releasing lever 231 moves counter-clockwise about the second pivot 236 above the locking member 232. Therefore, the recessed portion 239 of the locking member 232 is provided such that its open end faces upwards. The recessed portion 239 occupies a position such that when the second pivot 236 is thrust into the recessed portion 239, the second pivot 236 is substantially directly above the first pivot 234.

When the cover 100 of the fixing device 122 thus configured moves from the closed position shown in FIG. 10A to the open position shown in FIG. 10B, the tip end 231*b* of the pressure releasing lever 231 is pushed by the cover 100, rotating the pressure releasing lever 231 clockwise about the second pivot 236. This movement of the pressure releasing lever 231 causes the locking member 232, which is rotatably supported against the pressure releasing lever 231 by the third pivot 237, thrusting the first end 232*a* downward. This movement of the locking member 232 causes the second pivot 236 to retreat from the recessed portion 239, enabling the locking member 232 to be pulled by the tension coil spring 233 and causing the third pivot 237 move to the left of the second pivot 236 in FIGS. 10A and 10B and to the same side as the second end 232*b* of the locking member 232. In other words, the third pivot 237 continues to move towards the tension coil spring 233 until it reaches a position where the tension coil spring 233 returns to its natural length. When the locking member 232 shifts to a position such that the third pivot 237 assumes a position closer to the second end 232*b* of the locking member 232 than the second pivot 236, the pulling force of the tension coil spring 233 acts on the pressure releasing lever 231, and in addition, the weight of the cover 100 too acts on the pressure releasing lever 231. As a result, the pressure exerting lever 330 turns about the first pivot 234 in the direction in which the cover 100 is slanted, releasing the pressure from the pressure exerting roller 221.

When the cover 100 moves from the open position shown in FIG. 10B to the closed position shown in FIG. 10A, the tip end 231*b* of the pressure releasing lever 231 is pushed by the cover 100, causing the pressure releasing lever 231 and the pressure exerting lever 330 in a pressure exertion direction (towards the left in FIGS. 10A and 10B), and causing the pressure exerting roller 221 to come in pressure contact with the fixing belt 224. As the movement of the pressure exerting lever 330 is controlled, the pressure releasing lever 231 rotates in the counter-clockwise direction about the second pivot 236. With the rotation of the pressure releasing lever 231, the locking member 232, which is rotatably supported against the pressure releasing lever 231 by the third pivot 237, moves towards the right in FIGS. 10A and 10B with respect to the second pivot 236 against the spring force of the tension coil spring 233. As the pressure releasing lever 231 moves further towards the closed position, the second pivot 236 thrusts into the recessed portion 239, the movement of the pressure releasing lever 231 is controlled, and the spring pressure of the tension coil spring 233 acts on the locking member 232, biasing the locking member 232 in a locking direction B. Thus, the pressure releasing lever 231 is held in the locked position, and maintains the pressure exertion status between the pressure exerting roller 221 and the fixing belt 224.

The pressure exerting lever 330 and the locking member 232 are thus locked at a position that is farthest from the first pivot 234 about which the pressure exerting lever 330 rotates, and are pulled in the locking direction B by the spring force of the tension coil spring 233. Thus, by the principle of leverage, less force is required for the second pivot 236 to slide over the locking member 232 compared to when the locking member 232 is closer to the first pivot 234, and therefore, the less force is received by the second pivot 236 when sliding over the locking member 232.

Thus, in the present embodiment, unlike the conventional configuration, release of the pressure exertion status of the pressure exerting roller 221 and the fixing belt 224 is achieved without the help of an external driving device such as a motor. Consequently, reduction in weight as well as cost is achieved. Further, the pressure exerting lever 330 and the locking member 232 are locked at a position that is farthest from the first pivot 234 about which the pressure exerting lever 330 rotates, and are pulled by the tension coil spring 233. Thus, the resistive force opposing the sliding movement of the second pivot 236 over the locking member 232 is small, rendering the fixing device highly durable.

The tension coil spring 233 extends only to the extent required for the actuation of the pressure releasing lever 231. Therefore, the user needs to exert very little operating force. In addition, minimal extension of the tension coil spring 233 also keeps the resistive force due to the sliding contact between the tip end 231*b* of the pressure releasing lever 231 and the inner surface of the cover 100 from becoming excessive, preventing wear of the concerned components. Further, the tension coil spring 233 returns to its natural length when the cover 100 is in an open state and the pressure contact on the pressure exerting roller 221 is released as shown in FIG. 10B. Consequently, the components can be assembled easily as the components are not in a biased state.

In the present embodiment, the fixing nip of the fixing device is loosened when the cover 100 is opened. Therefore, when the cover 100 is opened when jamming occurs, the fixing nip loosens, making it easy to remove the jammed up sheet.

Figure 3:
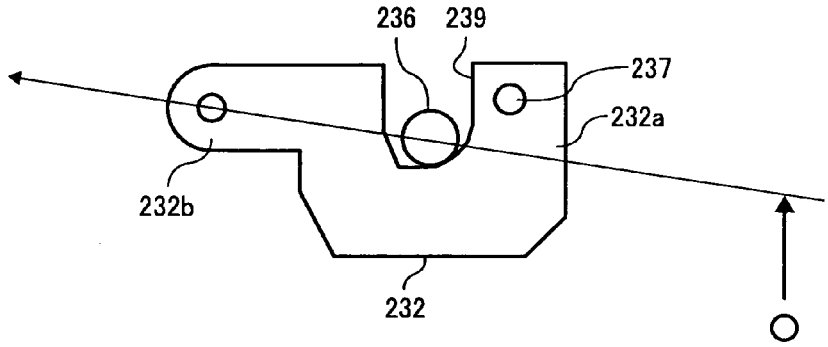
FIG. 3 is an enlarged view of a positional relation between a locking member and a second pivot.

When the pressure releasing lever 231 is in the pressure exertion position, if, as shown in FIG. 3, the third pivot 237 that serves as a hinge for the locking member 232 lies above a line O joining the second end 232*b* of the locking member 232 to which the tension coil spring 233 is hooked and the second pivot 236 that serves as a hinge for the pressure releasing lever 231, the pressure releasing lever 231 can potentially rotate in the counter-clockwise direction when the locking member 232 is pulled by the tension coil spring 233. However, the locking member 232 is held in position by the second pivot 236. When the pressure releasing lever 231 rotates to assume the pressure release position, the third pivot 237 of the locking member 232 rotates along with the pressure releasing lever 231 and assumes a position below the line O. From this point on, the pressure releasing lever 231 is pulled by the pulling force of the tension coil spring 233, and continues to rotate until the pressure exerting lever 330 comes in contact with the pressure control member 301. In such a configuration, a constant center distance between the pressure exerting roller 221 and the roller 223 can be maintained always, and hence a constant pressure can be maintained.

Figure 4:
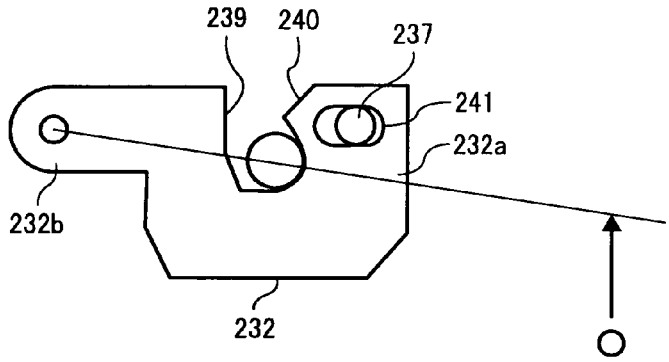
FIG. 4 is an enlarged view of a positional relation between a locking member having a projection and the second pivot.

If the actuation of the pressure releasing lever 231 is inadequate when the third pivot 237 of the locking member 232 is near the line O, the pressure releasing lever 231 will stop midway, leading to inappropriate pressure. As a solution to the problem, a projection 240 is provided inside the recessed portion 239 of the locking member 232 and an elongated slot 241 is provided in the first end 232*a* of the locking member 232, with the third pivot 237 freely fitting into the elongated slot 241, as shown in FIG. 4, so that the projection 240 comes to lie over the second pivot 236 of the pressure releasing lever 231. Thus, the pressure releasing lever 231 can be prevented from stopping in the middle, and a stabilized pressure can be realized.

Figure 5:
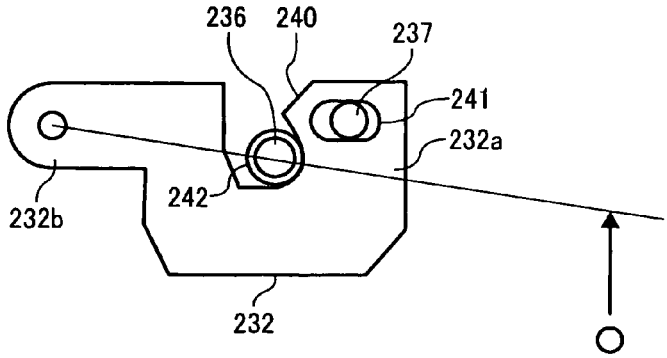
FIG. 5 is an enlarged view of a positional relation between the locking member having the projection and a second pivot having a pivot bearing.

However, when the projection 240 comes to lie over the second pivot 236 of the pressure releasing lever 231, the two can come in sliding contact, damaging the second pivot 236 over time. Therefore, as shown in FIG. 5, the second pivot 236 is fitted in a pivot bearing 242 so that the projection 240 comes to lie over the pivot bearing 242 rather than directly the second pivot 236. Thus, durability can be improved by protecting the second pivot 236 from abrading against the projection 240.

Figure 6:
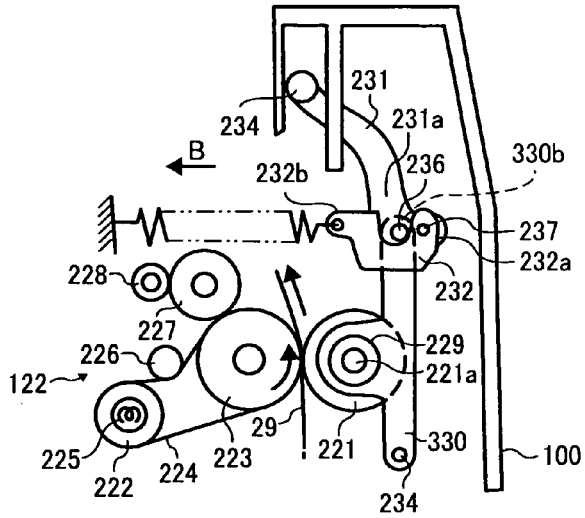
FIG. 6 is an enlarged view of the fixing device in which a roller is provided in a pressure releasing lever.

In FIGS. 10A and 10B, the tip end 231*b* of the pressure releasing lever 231 is directly in contact with the inner surface of the cover 100. A roller 243 can be rotatably provided at the tip end 231*b*, as shown in FIG. 6, to reduce the frictional force and to enable opening and closing the cover 100 more easily with less force, improving operability by the user.

Figure 7A:
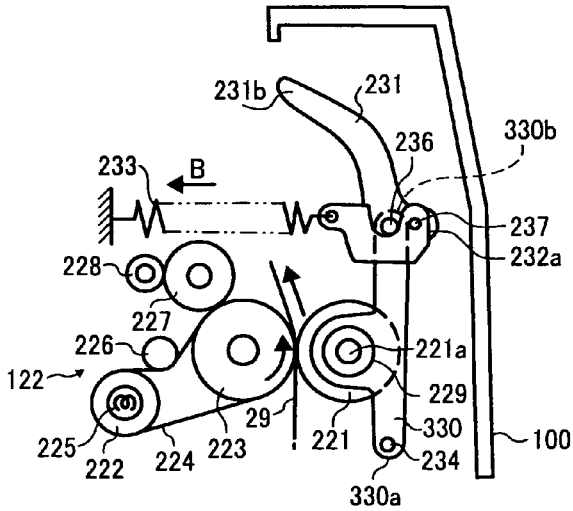
FIG. 7A is an enlarged view of a fixing device in a pressure exertion state, where the pressure releasing lever does not move with the opening and closing of the cover.
Figure 7B:
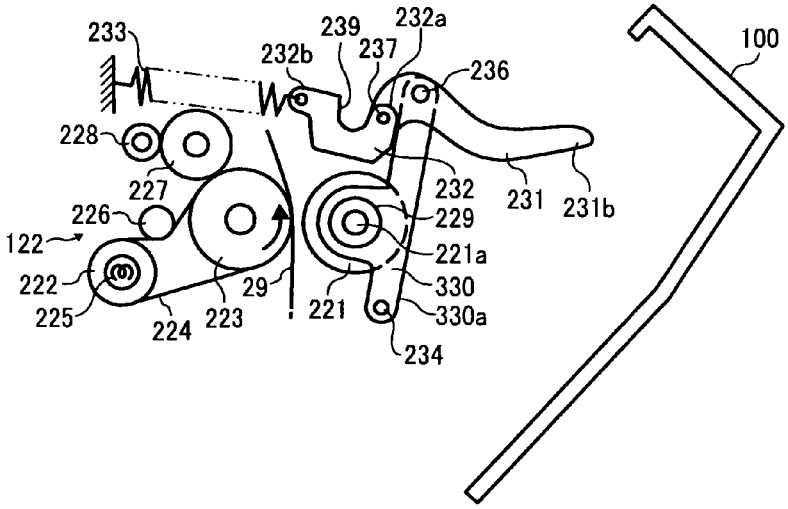
FIG. 7B is an enlarged view of the fixing device in a pressure release state, where the pressure releasing lever does not move with the opening and closing of the cover.

In the embodiments, the tip end 231*b* of the pressure releasing lever 231 is engaged with the cover 100, so that the pressure releasing lever 231 moves with the opening and closing of the cover 100. The pressure releasing lever 231 can be provided not attached to the cover 100, as shown in FIGS. 7A and 7B, so that it does not move with the opening and closing of the cover 100. When the cover 100 is in the open state as shown in FIG. 7B, the fixing device 122 is exposed to the outside, enabling the user to manually operate the pressure releasing lever 231 to loosen the pressure contact between the pressure exerting roller 221 and the fixing belt 224.

According to an aspect of the present invention, a fixing device having a simple structure and excellent durability and an image forming apparatus equipped with the fixing device can be provided. Further, by configuring the shaft bearing to fit into the pressure exerting lever, a clear separation of one fixing member from the other fixing member can be achieved during pressure release, thus preventing faulty image formation after jamming occurs. Further, the transfer sheet stuck in the fixing device can be easily freed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device that clamps a recording sheet between a first fixing member and a second fixing member and fixes a toner image on the recording sheet by applying heat and pressure, the fixing device comprising:

a pressure exerting lever that causes the first fixing member to exert pressure on the second fixing member, the pressure exerting lever having a first end and a second end, the first end being rotatably supported by a first pivot, the pressure exerting lever includes a fitting hole configured to hold a shaft bearing;

a pressure releasing lever that is rotatably supported against the pressure exerting lever;

a locking member having a first end and a second end, the first end being rotatably supported against the first end of the pressure releasing lever; and an elastic member that is hooked to the second end of the locking member and that pulls the locking member in a locking direction, wherein by turning the pressure releasing lever, a position of the locking member is switched between a pressure exertion position where the first fixing member exerts pressure against the second fixing member via the pressure exerting lever, and a pressure release position where the fixing member separates from the second fixing member, in the pressure exertion position, the elastic member pulls the locking member and the second end of the pressure exerting lever in the locking direction, a core end of the fixing member pressed by the pressure exerting lever is rotatably supported by the shaft bearing, and the shaft bearing is disposed within the fitting hole of the pressure exerting lever.

2. The fixing device according to claim 1, wherein a pressure exerted by the first fixing member on the second fixing member is controlled by rotatably supporting the first end of the pressure exerting lever on the first pivot and causing the second end of the pressure exerting lever to touch a pressure control member.

3. The fixing device according to claim 2, wherein a position of the pressure control member is variable.

4. The fixing device according to claim 2, wherein the position of the pressure control member is variable stepwise.

5. The fixing device according to claim 1, wherein one among the first fixing member and the second fixing member is a pressure exerting roller and other is a fixing belt wound around a pair of rollers.

6. The fixing device according to claim 1, wherein a surface temperature of the fixing members varies according to a clamping pressure exerted by the fixing members on the recording sheet.

7. The fixing device according to claim 1, wherein when the locking member switches from the pressure release position to the pressure exertion position, a second pivot that rotatably supports the pressure releasing lever and the locking member rotates about a third pivot and past a line joining the third pivot and the second end of the locking member, the third pivot rotatably supports the pressure releasing lever and the pressure exerting lever.

8. The fixing device according to claim 7, wherein the locking member fits into the third pivot in the pressure exertion position and disengages from the third pivot in the pressure release position, and when switching from the pressure release position to the pressure exertion position the second pivot gets past a projection provided in the locking member.

9. The fixing device according to claim 7, wherein the locking member fits into a pivot bearing that supports the third pivot in the pressure exertion position and disengages from the pivot bearing in the pressure release position, and when switching from the pressure release position to the pressure exertion position the pivot bearing gets past the projection provided in the locking member.

10. The fixing device according to claim 1, wherein an end of the pressure releasing lever engages with a cover supported to open and close against an apparatus body, enabling the pressure releasing lever to turn with the opening and closing of the cover.

11. The fixing device according to claim 10, wherein a roller is provided at the end of the pressure releasing lever.

12. An image forming apparatus comprising a fixing device that clamps a recording sheet between a first fixing member and a second fixing member and fixes a toner image on the recording sheet by applying heat and pressure, the fixing device including a pressure exerting lever that causes the first fixing member to exert pressure on the second fixing member, the pressure exerting lever having a first end and a second end, the first end being rotatably supported by a first pivot, the pressure exerting lever includes a fitting hole configured to hold a shaft bearing;

a pressure releasing lever that is rotatably supported against the pressure exerting lever;

a locking member having a first end and a second end, the first end being rotatably supported against the first end of the pressure releasing lever; and an elastic member that is hooked to the second end of the locking member and that pulls the locking member in a locking direction, wherein by turning the pressure releasing lever, a position of the locking member is switched between a pressure exertion position where the first fixing member exerts pressure against the second fixing member via the pressure exerting lever, and a pressure release position where the fixing member separates from the second fixing member, in the pressure exertion position, the elastic member pulls the locking member and the second end of the pressure exerting lever in the locking direction, a core end of the fixing member pressed by the pressure exerting lever is rotatably supported by the shaft bearing, and the shaft bearing is disposed within the fitting hole of the pressure exerting lever.

* * * * *